United States Patent [19]

Purssell

[11] 4,145,587

[45] Mar. 20, 1979

[54] SNAP ACTION SWITCHES

[75] Inventor: Robert F. Purssell, Plymouth, England

[73] Assignee: Ranco Incorporated, Columbus, Ohio

[21] Appl. No.: 818,381

[22] Filed: Jul. 25, 1977

[51] Int. Cl.[2] ..... H01H 21/04

[52] U.S. Cl. ..... 200/67 DA

[58] Field of Search ..... 200/67 D, 67 DA, 283

[56] References Cited

U.S. PATENT DOCUMENTS

| | | | |
|---|---|---|---|
| 2,584,460 | 2/1952 | Jacobs, Sr. | 200/67 DA |
| 3,057,982 | 10/1962 | Grover et al. | 200/67 DA X |
| 3,196,233 | 7/1965 | Burch et al. | 200/67 DA X |
| 3,449,534 | 6/1969 | Bauer | 200/67 D |

FOREIGN PATENT DOCUMENTS

| | | | |
|---|---|---|---|
| 560583 | 4/1944 | United Kingdom | 200/67 DA |

*Primary Examiner*—Herbert F. Ross

*Attorney, Agent, or Firm*—Watts, Hoffmann, Fisher & Heinke Co.

[57] ABSTRACT

A snap action switch blade has a pair of resiliently flexible arms projecting cantilever fashion from a support and drawn together to prestress the blade for snap action, the blade being anchored to the support by two lugs projecting in the opposite direction to the arms and an electrical contact being mounted off-axis near one of the arms of the blade.

14 Claims, 5 Drawing Figures

SNAP ACTION SWITCHES

This invention relates to snap action switches.

An object of the invention is to provide a snap action switch having a contact-carrying blade which effects snap movement between a closed and open condition of the switch in response to a narrow range of movement of a switch operating element, and which, having made such movement, can accommodate overtravel of the switch operating element by resilient deformation of the switch blade, without such overtravel resulting in a change of state of the switch.

According to the invention there is provided a snap action switch blade of resilient sheet metal formed with a base portion having two longitudinally extending arms, means interconnecting the arms at their ends remote from the base portion so as to induce a dish stressing of the base portion, two lugs projecting outwardly from the base portion adjacent the arms and affording mounting points for the blade, and an electrical contact carried by one of the arms or forming at least part of the means interconnecting the arms.

A central tongue preferably projects from the base portion between the two arms and is acted upon in use of the blade by a switch operating element.

It can be arranged that snap deformation of the switch blade can be effected by means of a narrow range of movement of the switch operating element, so as to cause snap transition of the blade from its initial dished configuration towards the opposite dished configuration, causing snap movement of the electrical contact carried by the blade.

The base portion, the arms and the lugs are preferably all formed from a single piece of sheet metal, for example, a beryllium-copper alloy. The means interconnecting the arms may comprise a bridge portion, integral with the remainder of the blade or welded to it. The requisite dish stressing of the blade may be effected by shortening of the bridge portion, for example by crimping or by severing the bridge portion and then lap-welding the adjacent severed ends of the bridge portion. Alternatively, the bridge portion and the electrical contact carried or formed thereby may be attached to the cantilevered ends of the arms, for example, by welding, maintaining the arms at a relative spacing which results in the dish stressing of the base portion.

The invention also provides a snap action switch having a switch blade as defined above, a support or housing to which the two lugs of the blade are anchored and from which the blade projects cantilever-fashion, a fixed contact carried by the support or housing and cooperating with the contact carried by the switch blade, and an operating element arranged to act on a cantilevered part of the blade in a sense to cause snap transition thereof towards an opposite dish deformation to effect snap movement of the contact carried by the blade relative to the fixed contact.

The two lugs are attached to the support, leaving the remainder of the blade including the base portion free to undergo transition from its original state of dish deformation towards the opposite state upon movement of the operating element. Once the switch blade has undergone such snap movement further movement of the switch operating element in the same direction will simply result in further deformation of the switch blade, without snap transition, so that the switch blade can accommodate a wide range of overtravel movement of the operating element. This is a particularly useful feature where the switch is of the temperature- or pressure-responsive type in which the operating element is actuated by a temperature- or pressure-responsive element such as a bellows or diaphragm. In practice the switch operating element may be connected directly to a temperature- or pressure-responsive element such as a bellows, diaphragm or bimetal device, without any interposed operating linkage, since any overtravel of the operating element as a result of excessive temperature or pressure is accommodated by deformation of the switch blade as previously mentioned.

The contact carried by the switch blade may be disposed in a different longitudinal plane from the point on the blade at which the operating element acts, the said point being spaced from the support or housing in both the open and closed condition of the contacts, so that after movement of the operating element in a direction so as to cause snap opening or closing of the switch contacts further movement of the operating element in the same direction results in twisting of the blade about a longitudinal axis without change of state of the switch. The contact carried by the blade is preferably located at or adjacent the cantilevered end of one of the two arms of the blade, the operating element acting at a point disposed symmetrically between the said two arms.

The differential of the switch when acting as a temperature or pressure-responsive switch, that is, the difference in temperature or pressure necessary to induce operation of the switch in opposite senses, can be pre-set by means of an adjustable stop carried by the switch support or housing and engaging a part of the switch blade. Preferably this adjustable stop, which may be in the form of a screw, acts upon the opposite face of the switch blade to that carrying the contact, at a point spaced from the latter in a transverse direction. By adjusting the setting of this stop the gap between the fixed contact and the contact carried by the blade in the open condition of the switch can be adjusted. The adjustable stop may be disposed on the opposite side of the longitudinal axis of symmetry of the blade from the contact carried by the blade.

By suitable positioning of the fixed contact and the adjustable stop it is possible to arrange that the switch is either monostable or bistable in operation. Where the switch blade undergoes snap transition into an opposite stable state of dish deformation in response to movement of the switch operating element and is therefore bistable in operation, a biassing spring may be provided to act upon the switch blade in opposition to the operating element to return the blade to its original dish deformation when the operating element is released. The biassing spring may comprise a helical spring reacting against the switch support or housing and acting upon the opposite face of the switch blade from that which is engaged by the switch operating element. The biassing spring may alternatively comprise a leaf spring.

The present invention will now be further described, by way of example, with reference to the accompanying drawings, in which.

Figure 1:
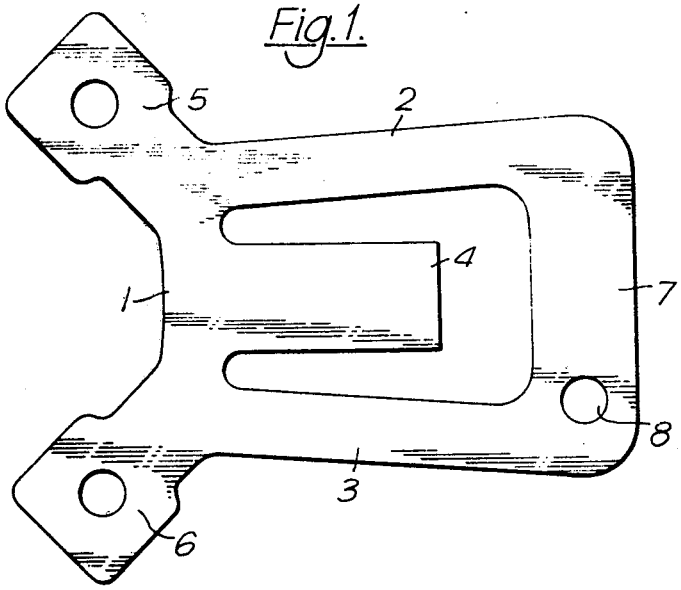
FIG. 1 is a plan view of a blank from which a snap action switch blade according to one embodiment of the present invention is made.

The switch blade according to the present invention is made from a single piece of beryllium-copper alloy. A blank having the shape shown in FIG. 1 is first stamped or cut from a sheet of beryllium-copper alloy, the sheet typically having a thickness of 0.3 mm. The blank has a base portion 1 formed with two arms 2, 3 adjoining opposite ends of the base portion, a central tongue 4 projecting from the base portion 1 and disposed symmetrically between the two arms, and two outwardly projecting lugs 5, 6 extending from opposite ends of the base portion 1 adjoining the two arms 2, 3. The two lugs 5, 6 are formed with holes at their ends for the reception of fixing screws or rivets by means of which the blade is anchored to a support or switch housing to project cantilever-fashion, as described with reference to FIGS. 2 to 5. The cantilevered ends of the two arms 2, 3 opposite the base portion 1 are interconnected by an integral bridge portion 7. A hole 8 is formed in one end of the bridge portion 7 adjacent one of the arms 2 for the attachment of a switch contact, on one side of the longitudinal axis of symmetry X—X of the blade blank.

Figure 2:
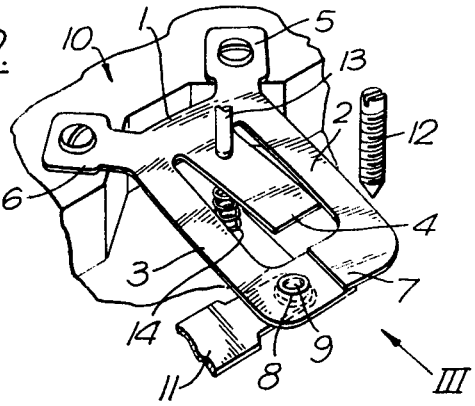
FIG. 2 is a diagrammatic perspective view of a switch blade according to one embodiment of the present invention incorporated in a temperature-responsive switch, parts only of the switch being shown diagrammatically.
Figure 4:
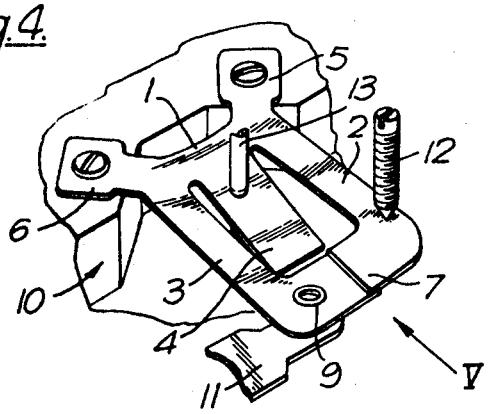
FIG. 4 is a diagrammatic perspective view similar to FIG. 2 but showing the switch blade after operation of the switch.

The two arms 2, 3 in the flat condition of the blank diverge relatively to each other away from the base portion 1. After stamping of the blank in a flat condition the blade is pre-stressed with a dish deformation by shortening the bridge portion 7, either by crimping the bridge portion or, in this example, by making a cut in the bridge portion 7 and then forming a lap-joint between the cut ends of the bridge portion 7, as illustrated in FIGS. 2 and 4, so that the length of the bridge portion is effectively reduced. The result of this shortening of the bridge portion 7 is to draw the two arms 2, 3 together so that they are substantially parallel with each other, at the same time inducing a dish deformation in the base portion 1 of the blade, as shown in FIG. 2.

A contact 9 is attached to the blade at the position of the hole 8 by rivetting or swaging. Alternatively, a contact may be formed integrally with the bridge portion 7 or may in fact constitute the bridge portion 7 itself, in which case it may be attached to the arms 2, 3 by welding in such a way as to hold the arms at the requisite spacing to cause the dish stressing of the blade.

Figure 3:
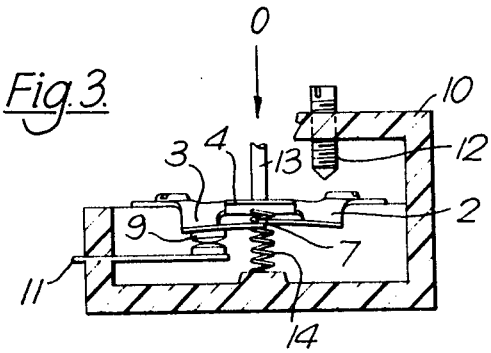
FIG. 3 is an end view of the switch blade in the direction of arrow III in FIG. 2.

A typical mounting for the switch blade is illustrated in FIGS. 2 and 3. The blade is attached to a housing 10, part of which is shown diagrammatically, by rivets, screws or other attachments passing through the lugs 5, 6 so that the blade projects cantilever-fashion within the housing. The contact 9 carried by the blade cooperates with a fixed contact 11 carried by the housing 10. In the illustrated embodiment the switch is normally closed with the contact 9 pressed into engagement with the fixed contact 11 by the dish stressing of the blade which in the illustrated example results in the blade being convex upwardly as viewed in FIG. 2.

A differential setting screw 12 is mounted in the housing 10 and acts upon the opposite face of the blade from the contact-carrying face, at the end of the bridge portion 7 opposite the contact 9, that is, on the opposite side of the longitudinal axis of symmetry of the blade from the contact 9.

A switch operating element 13, which may, for example, be movable by a deformable temperature responsive bellows or diaphragm or by a bimetal device, acts upon the central tongue 4 of the switch blade adjacent the base portion 1, on the opposite face of the switch blade from that which carries the contact 9. Displacement of the operating element 13 in the direction of arrow 0 opposes the dish deformation of the switch blade, and when this displacement reaches a certain point the switch blade will undergo snap transition towards its opposite dished configuration, shown in FIG. 4, in which the blade is shown concave upwardly. This snap transition will result in rapid movement of the contact 9 carried by the switch blade away from the fixed contact 11, causing snap opening of the switch (FIG. 5).

The switch blade could be set up for monostable or bistable operation by suitable selection of the position of the fixed contact 11 and the blade anchorage points. In the illustrated embodiment the switch blade is bistable, so that once the switch has been opened by movement of the switch operating element 13 as described above, subsequent release of the switch operating element 13 would not result in return of the switch to its original closed condition, the dished configuration adopted by the switch blade in the open condition (FIGS. 4 and 5) being a stable condition. In order to make the switch effectively monostable in operation a helical biassing spring 14 is provided, one end of the spring 14 reacting against the switch housing 10 and the other end bearing against the tongue 4 on the opposite face thereof from the switch operating element 13. The spring 14 exerts a sufficiently strong return force on the tongue 4 to cause the latter to return to its initial position when the switch operating element 13 is released, so that the switch blade reverts to its original dished configuration (FIGS. 2 and 3) with the contacts 9, 11 closed.

By adjusting the setting of the differential screw 12 the dish deformation of the switch blade can be adjusted within fine limits so as to approach the point of snap transition to the opposite dished configuration. This in turn adjusts the sensitivity or "differential" of the switch, since it predetermines the separation of the contacts 9 and 11 when the switch is open (FIG. 5). The differential of the switch is, therefore, finely adjustable by means of the screw 12.

Figure 5:
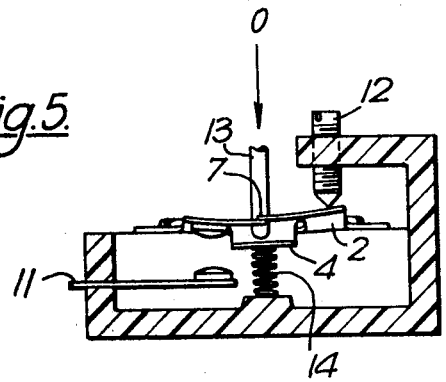
FIG. 5 is an end view of the switch blade, corresponding to FIG. 3, taken in the direction of arrow V in FIG. 4.

Once the switch blade has been caused to snap into its open condition by movement of the operating element 13 as shown in FIGS. 4 and 5 any further movement of the switch operating element 13 in the direction of arrow 0, for example due to excessive temperatures sensed by the bellows, diaphragm or other device controlling the operating element 13, will result in resilient deformation of the tongue 4 and the adjacent base portion 1 of the blade, at the same time twisting the blade about a longitudinal axis by virtue of the engagement of the asymmetrically positioned setting screw 12 with the blade, such deformation having no effect on the condition of the switch — that is, the switch contacts 9, 11 will remain open. The switch blade can accommodate a wide range of overtravel movement of the switch operating element in this way without suffering damage or affecting its subsequent operation.

Although the illustrated switch is of the normally closed type, a normally open switch can easily be made by positioning the fixed contact 11 adjacent the opposite face of the switch blade from the position shown in FIGS. 2 to 5, so that closure of the switch occurs upon movement of the switch operating element 13 in the direction of arrow 0.

A further possible variant of the invention is a changeover switch having a further pair of contacts including a second fixed contact cooperating with a second contact positioned, for example, at the end of the arm 2 on the opposite face of the blade from the contact 9 of the illustrated embodiment. The second fixed contact would occupy the position of the differential setting screw 12 of the illustrated embodiment, and the further pair of contacts would be open when the first pair of contacts 9, 11 are closed and closed when the first pair of contacts 9, 11 are open.

I claim:

1. A snap action switch blade comprising:

a single piece of resilient sheet metal formed with a base portion, two longitudinally extending arms projecting in one direction from one side of the base portion, a central longitudinally extending tongue projecting from the same side of the base portion symmetrically between the two arms and having a free end disposed between the two arms, and two fixing lugs projecting from the opposite side of the base portion each lug supporting the blade in cantilever fashion;

means interconnecting the ends of the two arms remote from the base portion and to predispose the blade for snap movement in response to the application of an operating force to the tongue, and a single contact carried at the ends of the arms remote from the base portion and located in a position spaced from the longitudinal axis of symmetry of the blade which passes through the tongue.

2. The switch blade defined in claim 1, wherein the means interconnecting the arms comprise a bridge portion secured to the two arms and drawing said two arms together to effect the dish stressing of the base portion.

3. The switch blade defined in claim 1, wherein the means interconnecting the arms comprise a bridge portion integral with the remainder of the blade.

4. The switch blade defined in claim 3, wherein the dish stressing of the blade is effected by shortening of the bridge portion to draw together the ends of the arms remote from the base portion.

5. The switch blade defined in claim 4, wherein the two arms have end portions projecting laterally inwardly towards each other at the ends of the arms remote from the base portion, said end portions being welded together to form the bridge portion.

6. The switch blade defined in claim 1, wherein the two outwardly projecting lugs diverge relative to each other from the base portion.

7. The switch defined in claim 1, including a second contact carried on the opposite face of the blade from the first mentioned contact carried by the blade, and on the other side of said longitudinal axis of symmetry of the blade, the said second contacts being closed when the first contacts are open and open when the first contacts are closed.

8. The switch blade claimed in claim 1, wherein said lugs are spaced apart from each other along said base portion and diverge from each other proceeding away from said base portion.

9. The switch blade claimed in claim 8, wherein said lugs extend from opposite ends of the base portion and define mounting portions disposed laterally outwardly from adjacent respective ones of said arms.

10. The switch blade claimed in claim 9, wherein said means interconnecting the ends of the arms remote from the base portion cause said arms and base portion to assume a dished configuration and said lugs extend generally radially away from the center of said dished configuration.

11. A snap action switch comprising:

a switch blade of resilient sheet metal formed with a base portion, two longitudinally extending arms projecting in one direction from one side of the base portion, a central longitudinally extending tongue projecting from the same side of the base portion symmetrically between the arms, and having a free end between the two arms, and two lugs projecting outwardly from the opposite side of the base portion from the respective arms, said lugs individually effective to provide a cantilever support for said blade;

means interconnecting the ends of the two arms remote from the base portion and beyond the free end of the tongue to induce dish stressing of the base portion;

an electrical contact carried at the ends of the arms remote from the base portion;

a support to which the two lugs of the blade are anchored and from which the blade projects cantilever-fashion;

a fixed contact carried by the support and cooperating with said electrical contact carried by the switch blade, and an operating element acting upon the central tongue of the blade in a sense to cause snap transition thereof towards an opposite dish deformation to effect snap movement of the contact carried by the blade relative to the fixed contact.

12. The switch defined in claim 11, wherein the contact carried by the switch blade is located in a position spaced from the longitudinal axis of symmetry of the blade which passes through the tongue upon which the operating element acts, said tongue being spaced from the support in both the open and closed condition of the contacts, whereby after movement of the operating element in a direction so as to cause snap operation of the switch further movement of the operating element in the same direction results in twisting of the blade about the said longitudinal axis without change of state of the switch.

13. The switch defined in claim 12, including an adjustable stop carried by the support and acting upon the opposite face of the switch blade to that carrying the contact, at a point disposed on the other side of the said longitudinal axis of symmetry of the blade from the said contact.

14. The switch as defined in claim 11, including a biassing spring acting upon the tongue of the switch blade in opposition to the operating element to return the blade to its original dish deformation when the operating element is released.

* * * * *